US005830112A

United States Patent [19]

Wang et al.

[11] Patent Number: 5,830,112

[45] Date of Patent: Nov. 3, 1998

[54] FOLDABLE JOGGING SIMULATOR

[75] Inventors: Leao Wang; Peter Wu, both of Taichung Hsien, Taiwan

[73] Assignee: Greenmaster Industrial Corp., Taichung Hsien, Taiwan

[21] Appl. No.: 951,395

[22] Filed: Oct. 16, 1997

[51] Int. Cl.[6] ..... A63B 69/16; A63B 22/00

[52] U.S. Cl. ..... 482/52; 482/57

[58] Field of Search ..... 482/51, 52, 53, 482/57, 62, 70, 79, 80, 54

[56] References Cited

U.S. PATENT DOCUMENTS

| | | | |
|---|---|---|---|
| 4,635,928 | 1/1987 | Ogden et al. | 482/54 |
| 5,383,829 | 1/1995 | Miller | 482/57 |
| 5,401,226 | 3/1995 | Stearns | 482/70 |
| 5,407,409 | 4/1995 | Tang | 482/70 |
| 5,593,372 | 1/1997 | Rodgers | 482/52 |
| 5,685,804 | 11/1997 | Whan-Tong et al. | 482/51 |

*Primary Examiner*—Stephen R. Crow
*Attorney, Agent, or Firm*—Bacon & Thomas, PLLC

[57] ABSTRACT

This invention pertains to a foldable jogging simulator in which each of the ends of two corresponding C-shape joint-bar pedals set has an action crank which powers a gear plate. Each of these gear plates has a toothed chain which is linked to a small gear. The two small gears on both sides are connected to the same pivoted shaft, providing a coordinated action with the two joint-bar pedals set. Furthermore, since a retarding wheel is installed in the middle of the pivoted shaft, a retarding force of motion is created; and as the other end of the joint-bar pedals set is installed with a coaxial sliding wheel, which adjusts is position (up and down) due to the rotation of a threaded column, the accidental disconnection of two pedals set is prevented. Finally, the base of the slanted support bar at the front portion is pivotally connected to a horizontal bar in the front of the machine, and this allows the machine to be folded, reducing its size and facilitate storage or transportation.

2 Claims, 6 Drawing Sheets

FOLDABLE JOGGING SIMULATOR

BACKGROUND OF THE INVENTION

1. Field of the Invention

The present invention relates to a type of jogging simulator, and more particularly to a type which conforms to human kinematics and has a better retarding force to facilitate exercising. Moreover, it is a novel invention which may be easily folded and stored, or transported.

A foldable jogging simulator is an exercise machine whose development is based on the characteristic of foot motion of a running person. The characteristic is the large foot span in the forward direction and small displacement in the up and down direction. It is different from a typical walking movement.

2. Description of the Prior Art

At present there is a foldable jogging simulator developed by other company, as shown in FIG. 1. This prior art, as described in U.S. Pat. No. 5,242,343, has two handle arms 11 beside main body 10. There are pedals 12 and pedal support bars 13 connects to a crank 14. Therefore when people steps on pedals 12 to have the pedal support bars 13 make an up down motion, the two handle arms 11 move back and forth synchronously. In addition, the other end of pedal support bars 13 moves with crank 14 to have rotation wheel 15 rotates in one direction.

FIG. 2 shows a prior art, U.S. Pat. No. 5,383,829. In the main body 10, there is a fixed guiding rod 16 below pedal support bars 13 so that the roller sets 17 can move along the guiding rod 16.

FIG. 3 shows a prior art, U.S. Pat. No. 5,518,473. In the main body 10, there is a swing type guiding rod 18 below pedal support bar 13 so that the roller sets 17 can move along the guiding rod 18.

From the three prior arts it can be seen that there is a long distance between pedal 12 and the rotation wheel. Since the end of pedal support bars 13 connects to a crank 14, not only the main body 10 has longer length, its motion is not smooth. In summary, the indirect driving methods for wheel 15 generate intermitted retarding resistance and smooth operation of the exercise can not be achieved.

For this reason, there is a prior art U.S. Pat. No. 5,562,574. From the figure it can be seen that handle arms 11 and pedal 12 is connected together. The other end of pedal 12 connects to a push rod 19. When stepping pedal 12, the push rod 19 are forced to move along a gliding plate 20 by roller set 17 at the end of the push rod 19. In the same time, the front end of push rod 19 drives the rotation wheel 15.

Among similar prior arts, there has not been a structural design which allows the machine to be folded to reduce size, and this makes storage and transportation more troublesome.

Therefore, with respect to the prevailing defects and imperfections in the usage and design of the various known jogging simulators, this inventor, upholding the spirit to improve on prior arts, has worked continuously to research and modify in the hope of utilizing a more reasonable structural design which conforms to the normal exercising posture and position of the human legs. This inventor has also provided an adjustable motion retarding structure which allows the user to adjust according to his or her own physical conditions so that the anticipated exercising effect may be achieved.

Another objective of this invention is in facilitating transportation and storage; therefore, a foldable device is equipped on the front support bar which greatly reduces the size of the entire machine.

SUMMARY OF THE INVENTION

A primary object of the present invention is to provide a foldable jogging simulator which conforms to the normal exercising posture and position of the human legs, and provides an adjustable motion retarding structure which allows the user to adjust according to their own physical conditions so that the anticipated exercising effect may be achieved.

Another object of the present invention is in facilitating transportation and storage, so that a foldable device is equipped on the front support bar which greatly reduces the size of the entire machine.

BRIEF DESCRIPTION OF THE DRAWINGS

The techniques, skills and other effects used in this invention will be more clearly understood from the following detailed description and the accompanying drawings, in which.

DETAILED DESCRIPTION OF THE PREFERRED EMBODIMENTS

Figure 2:
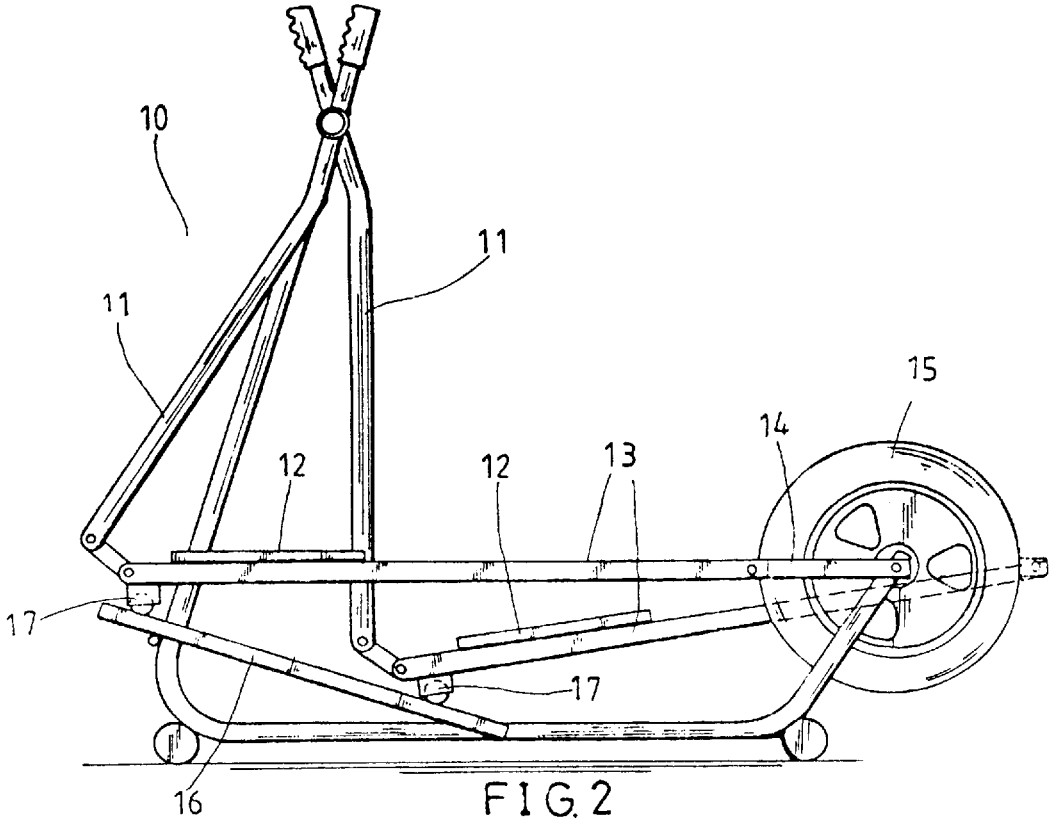
FIG. 2 PRIOR ART
FIG. 2 illustrates the prior art, U.S. Pat. No. 5,383,829.
Figure 1:
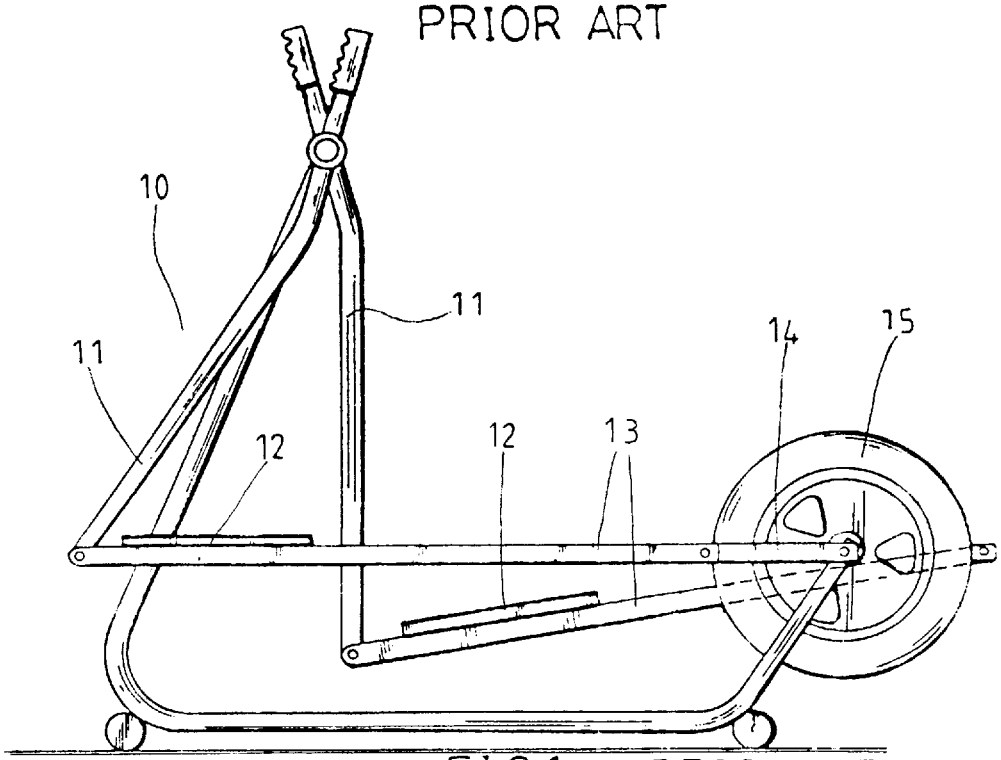
FIG. 1 PRIOR ART
FIG. 1 illustrates the prior art, U.S. Pat. No. 5,242,343.
Figure 3:
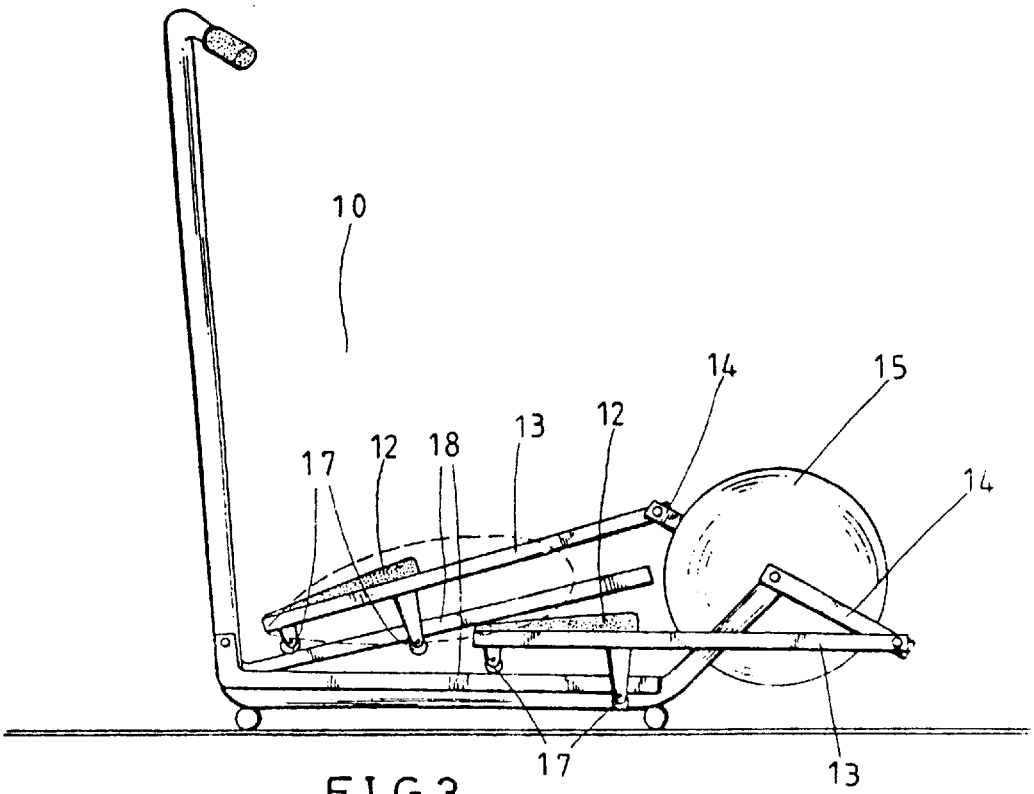
FIG.3 PRIOR ART
FIG. 3 illustrates the prior art, U.S. Pat. No. 5,518,473.
Figure 4:
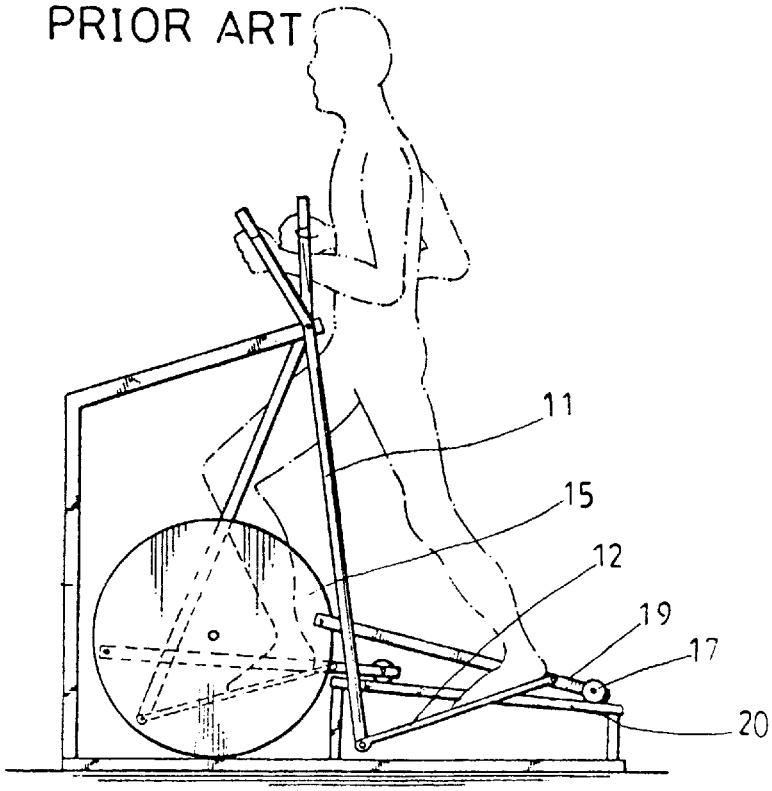
FIG.4 PRIOR ART
FIG. 4 illustrates the prior art, U.S. Pat. No. 5,562,574.
Figure 5:
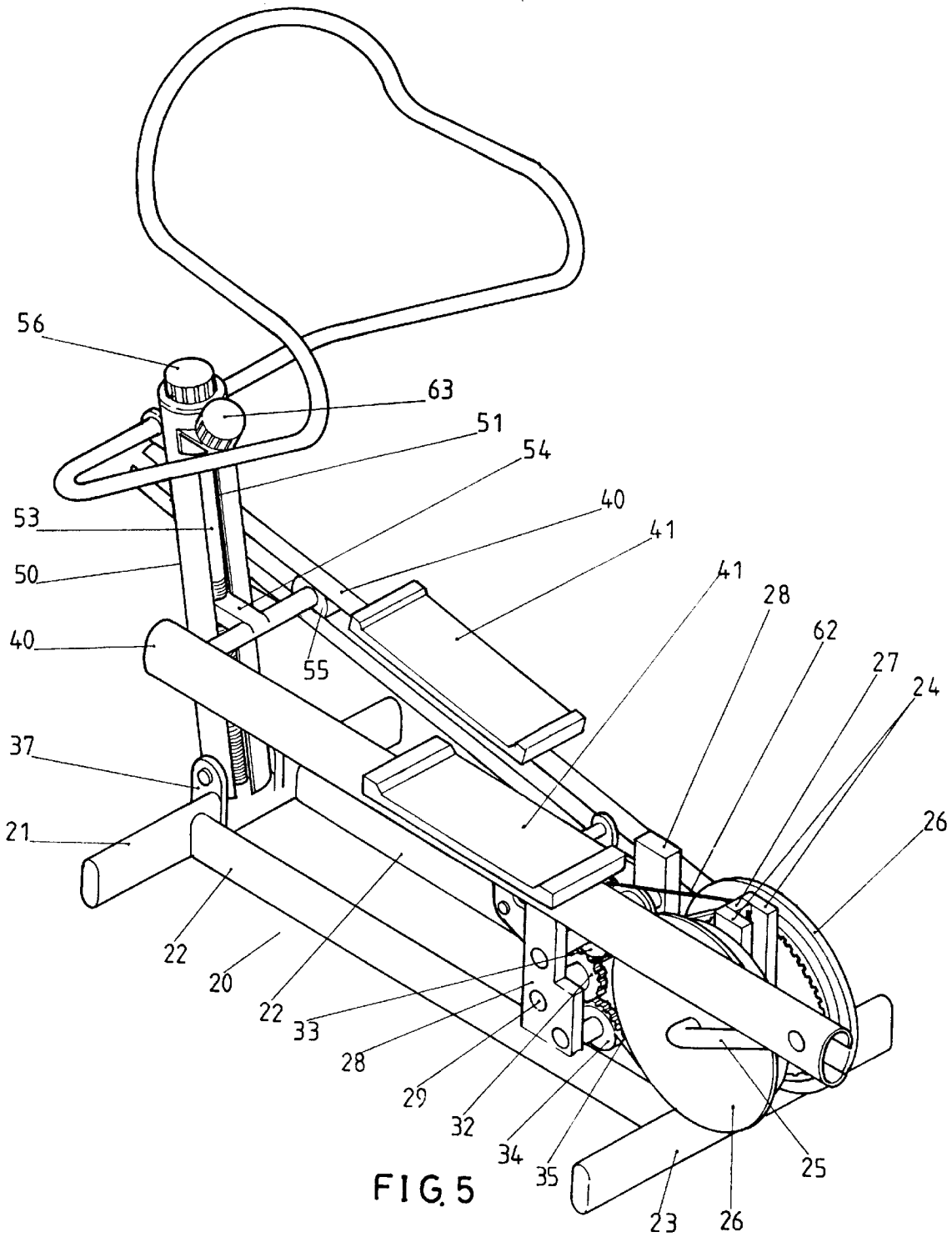
FIG. 5 is a three-dimensional view of the machine according to the present invention in an assembled state.

Please refer to FIGS. 5, 6, 7 and 8, which consist of: A base 20 which is formed by a front horizontal tube 21, two middle tubes 22 and a rear horizontal tube 23. Two vertical columns 24 are equipped, at a suitable position, on the surface of the rear horizontal tube 23. On the corresponding exterior of these vertical columns 24, a gear plate 26 is pivoted or rotatably mounted with an action crank 25. At the same time, a connecting piece 27 is installed within the two vertical columns 24 and this further stabilizes the position of the columns. The surfaces of the two middle tubes 22 are each equipped with a frame 28 and both are in a corresponding position. A pivoted or rotatable shaft 29 is placed in the corresponding interior surfaces of these frames 28, and is equipped with a set of small gears 32 which allows two toothed chains 35 to link the corresponding gear plates 26 and small gears set 32. A rolling wheel 33, 34 is fixed on the top- and bottom-end of the small gears set so as to press tightly against the positions of the corresponding chains 35 to prevent them from slipping. The retarding wheel 36 is fixed in the middle of the pivoted shaft 29 of the small gears set 32, and it rotates simultaneously with the rotation of the small gears set 32. The surface of the front horizontal tube 21 is equipped with two protruding flaps 37 to which the slanted support bar 50 is pivotably connected.

The two joint-bar pedals set 40 in the shape of C and a pedal 41 is fixed on a suitable position on the surface of the pedals set. The ends of the set are each pivoted to an action crank 25 of corresponding gear plates 26. The other end of each of the pedals set is connected to the corresponding sliding wheels 55 on a T-shape frame 54 which is fixed on the slanted support bar 50.

Figure 9:
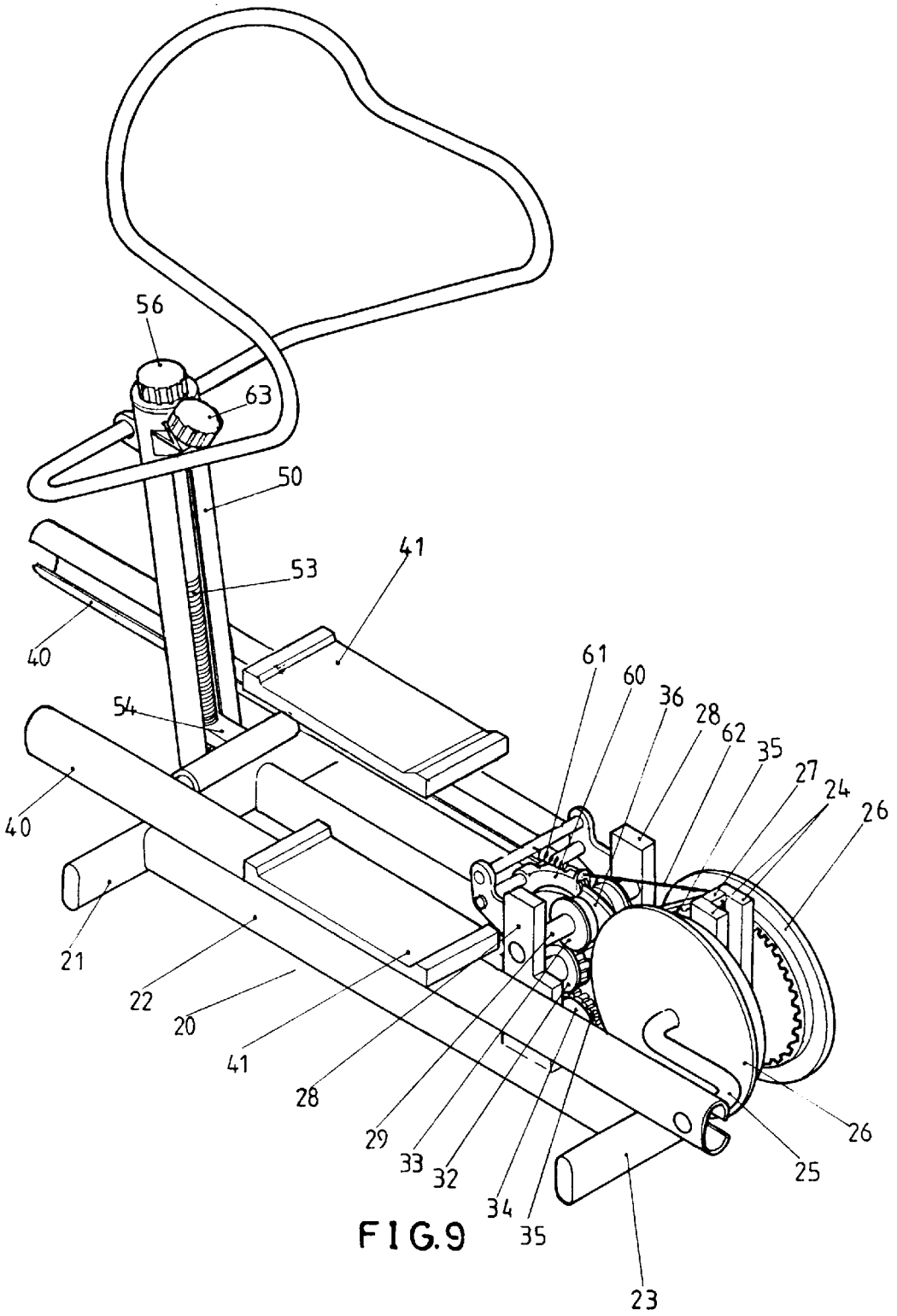
FIG. 9 is a diagrammatic view of the position of the two joint-bar pedals set after the position of the sliding wheels set is lowered.

A slanted support bar 50 with a longitudinally opened groove 51 which is pivoted to the protruding flaps 37 on the front horizontal tube 21 of the base 20 via the pivoting hole at its base. A stopper 52 is also designed to block the contact surface of the front horizontal tube 21 so as to set the angle of the support bar. The interior of the longitudinally opened groove 51 is equipped with a threaded bar 53, which fixed with a T-shape frame 54. The two sides of the T-shape frame 54 are equipped with a sliding wheel 55 each, which encompasses the corresponding joint-bar pedals set 40. Furthermore, the top of the slanted support bar 50 has a tuner 56 for the threaded bar which, when turned, causes the threaded bar 53 to rotate in its position and the T-shape frame 54 to move up and down due to the effect of the spirals (as seen in FIG. 9).

An adjustable magnetic retarding device consisting of a magnetic iron frame 60 in the shape of an inverted U, a spring 61, a tractor 62 and a tuner 63, in which, the interior surface of the magnetic iron frame 60 is equipped with an orderly arrangement of magnets and it is positioned within the circumference of the retarding wheel 36 so as to form a slicing resistance. The rotation of the tuner 63, in coordination with the tractor 62 and the spring 61, causes the magnetic iron frame 60 to pull closer and pull further away from the retarding wheel 36. Simply put, the closer the distance between the magnetic iron frame 60 and the retarding wheel 36, the stronger is the resistance, and vice versa.

Therefore, utilizing the above-described structural design, when the pedals 41 are stepped upon, the joint-bar pedals set 40 will move up and down. At the same time, this will cause the rear-end corresponding gear plates 26 to rotate in one direction. Meanwhile, the chain 35 will cause the small gears set 32 to move in turn, and since the small gears set 32 is on the same axis, a chained motion will result in the joint-bar pedals set 40. On the other hand, the retarding wheel 36 will rotate simultaneously with the rotation of the small gears set 32, and as one side of the retarding wheel 36 is equipped with a magnetic retarding device, an appropriate amount of resistance will be lent to the joint-bar pedals set 40, thus, enhancing the exercising effect. Naturally, due to the effect of the gear plates 26, there is forward and backward movement of the joint-bar pedals set 40, and the other end of the pedals set will slide forward and backward on the sliding wheels 55 on the T-shape frame 54. Therefore, the motion of the human legs when exercising is virtually simulated.

Figure 10:
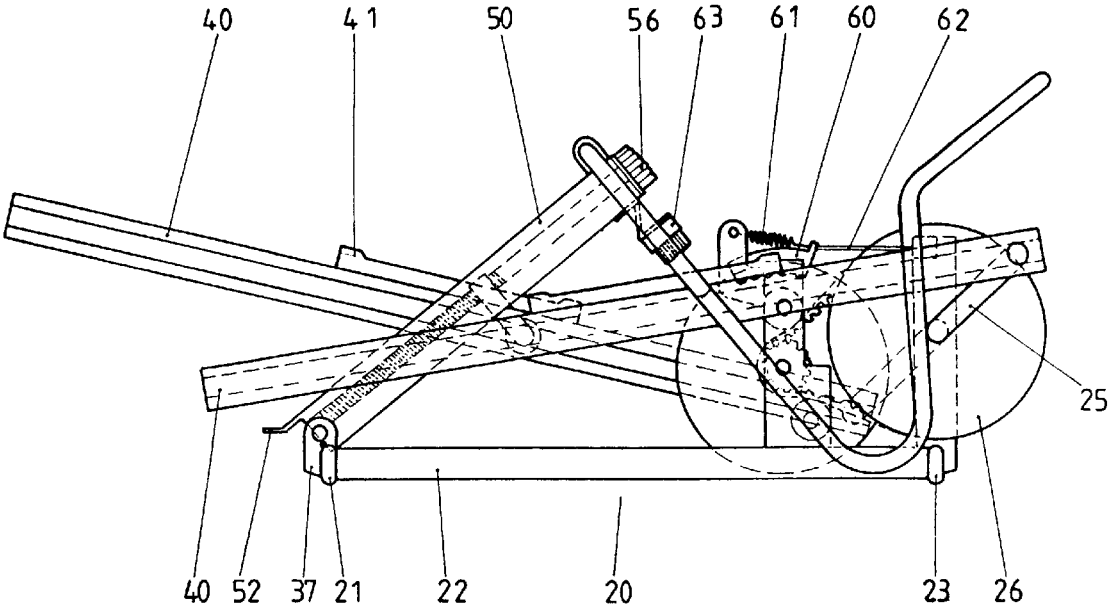
FIG. 10 is a diagrammatic view of the present invention in a folded state.
Figure 6:
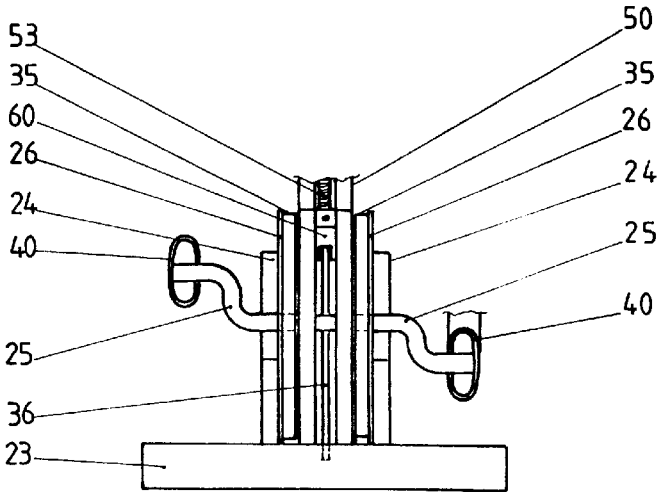
FIG. 6 is a diagrammatic view of the positions of the rear horizontal tube and gear plates of this present invention.
Figure 7:
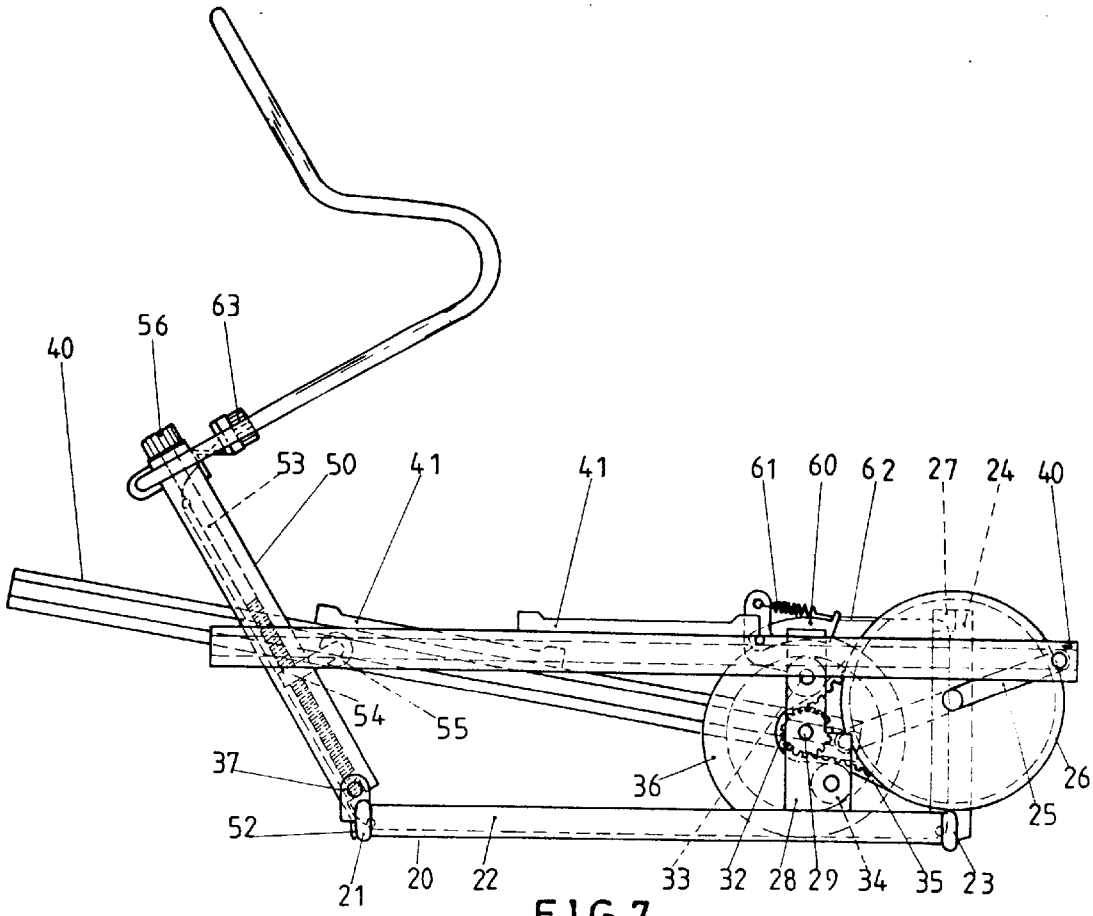
FIG. 7 is a side (and perspective) view of FIG. 5.
Figure 8:
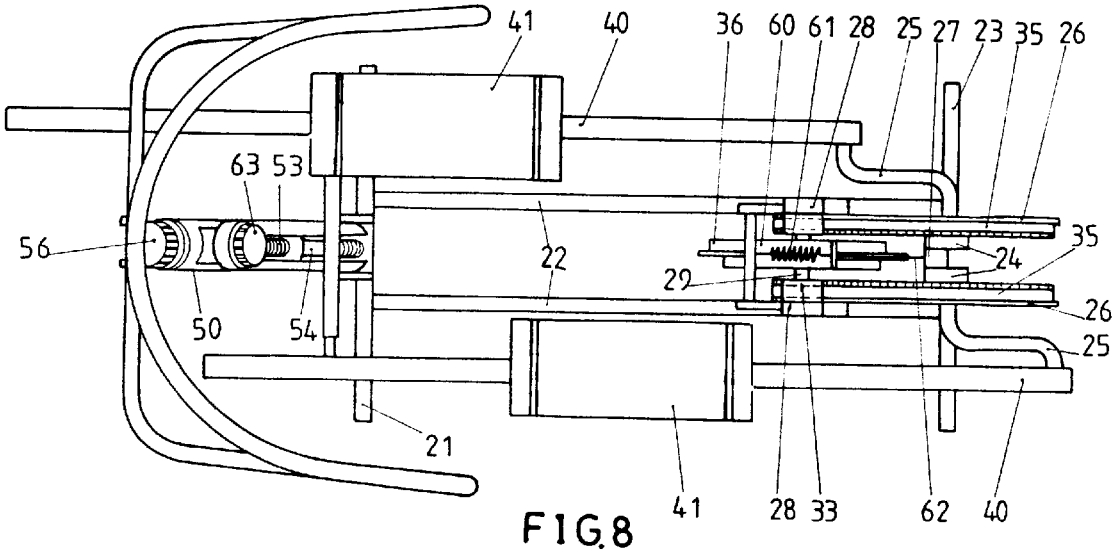
FIG. 8 is a top view of FIG. 5.

In addition, please refer to FIG. 10. When folding the machine for storage or transportation, simply fold the slanted support bar 50 toward the direction of the retarding wheel 36 in order to reduce size and save on the space occupied.

From the foregoing description, the foldable jogging simulator may achieve its objects with the subject matter disclosed herein. While a particular embodiment of the present invention has been illustrated and described, it shall be obvious to those skilled in the art that various other changes and modifications can be made without departing from the spirit and scope of the invention. It is therefore intended to cover in the appended claims all such changes and modifications that are within the scope of the present invention.

What is claimed is:

1. A foldable jogging simulator, comprising:

a base including a front horizontal tube, two middle tubes and a rear horizontal tube;

two vertical columns disposed at a suitable position on a surface of the rear horizontal tube, the two vertical columns including a connecting piece installed therebetween for further stabilizing the columns;

a gear plate rotatably mounted on a corresponding exterior of each of the vertical columns;

an action crank mounted on each of the gear plates;

a frame disposed on a surface of each of the middle tubes in a corresponding position;

a rotatable shaft rotatably mounted between corresponding interior surfaces of the frames;

a set of small gears fixed on the shaft;

a retarding wheel centrally fixed on the shaft between the small gears set such that it rotates simultaneously with rotation of the small gears set;

two toothed chains linking the corresponding gear plates and small gears;

rolling wheels fixed at a top-end and at a bottom-end of the small gears set so as to press against the corresponding chains to prevent them from slipping;

two protruding flaps disposed on a surface of the front horizontal tube;

a slanted support bar pivotably connected to the two protruding flaps, the support bar having a longitudinally opened groove and a stopper designed to block a contact surface of the front horizontal tube so as to set the angle of the support bar;

a threaded bar disposed within the longitudinally opened groove;

a T-shape frame fixed to the slanted support bar via the threaded bar;

sliding wheels disposed on each side of the T-shape frame;

a tuner for the threaded bar disposed on a top of the slanted support bar which, when turned, causes the threaded bar to rotate in its position and the T-shape frame to move up and down because of the threads thereon;

two C-shape joint-bar pedals pivotably connected to the action crank at one end and slidably connected to the sliding wheels at the other end; and a pedal fixed at a suitable position on a surface of each of the joint-bar pedals.

2. The foldable jogging simulator according to claim 1, wherein the simulator is folded for storage or transportation by simply folding the slanted support bar towards the direction of the retarding wheel.

* * * * *